United States Patent [19]

Hannon

[11] 4,380,120

[45] Apr. 19, 1983

[54] NAIL CLIPPING RETAINER

[76] Inventor: William B. Hannon, P.O. Box 187, Kihei, Hi.

[21] Appl. No.: 232,503

[22] Filed: Feb. 9, 1981

[51] Int. Cl.[3] ..... A45D 29/02

[52] U.S. Cl. ..... 30/28

[58] Field of Search ..... 30/28, 124

[56] References Cited

U.S. PATENT DOCUMENTS

| | | | |
|---|---|---|---|
| 860,975 | 7/1907 | Havell | 30/28 |
| 3,031,754 | 5/1962 | Pocoski | 30/28 |
| 3,169,312 | 2/1965 | Fink | 30/28 |
| 3,986,257 | 10/1976 | Kiura | 30/28 |

*Primary Examiner*—Jimmy C. Peters
*Attorney, Agent, or Firm*—Herbert C. Schulze

[57] ABSTRACT

This invention is an apparatus which retains nail clippings within a nail clipper during the process of clipping. The retaining member is attached to one side of the clipper assembly and has retaining walls for shielding the clippings from being scattered in an undesired manner away from the proximity of the clipper. Alternate embodiments are placed within the confines of the clipper and a flexible shroud which surrounds the cutting members of the clipper. The invention is further characterized by the clipper cutting edges being angularly disposed for a better approach to the cutting of finger nails and toe nails.

2 Claims, 16 Drawing Figures

NAIL CLIPPING RETAINER

CROSS REFERENCE TO RELATED PATENT APPLICATIONS

There are no patent applications filed by me related to this application but a patent application familiar to me in this field is herewith mentioned: U.S. Pat. No. 2,887,773.

BACKGROUND OF THE INVENTION

1. Field of the Invention

This invention is in the general field of nail clipping devices that are used for clipping of fingernails and toenails. The invention is particularly related to retaining the clipping during the clipping process from being scattered in an undesirable manner. The invention is further directed toward a unique method of adapting such retainment means in a simple and economical manner.

2. Description of the Prior Art

The pocket-type of nail clipper has been used for many years and has been most widely used in a configuration having a pair of actuating members each with an arcuate cutting edge at one end thereof. During the use of the clipper, the clippings tend to be scattered in all directions, and cause much effort in locating and retrieving these clippings. The clippings also tend to embarrass the user and often provide a sharp object which has to be dealt with as to being retrieved and disposed of properly.

The present invention is unlike any of the prior art in that it provides a simple inexpensive method of attaching a clipping retainer to such an existing conventional clipper.

The apparatus for accomplishing this clipping retainment during the clipping process is easily attached to the clipper by an inexperienced person.

THE SUMMARY OF THE INVENTION

There have been efforts made to retain the clippings from a nail clipper. Such devices, to the present invention, have rather consistently been molded to fit a particular size nail clipper and have involved a very complex method for forming such a retaining means.

Such devices have also been easily lost when separated from the clipper for emptying purposes. Devices of this nature have also been inadequate for adaptation to more complicated clipper having integral nail files and actuating levers.

I have studied this problem and have devised an apparatus which is easily adapted to most conventional nail clippers.

I have found that it is easily emptied of collected nail clippings and can be interchanged for color matching with a minimum of cost. I have now solved the problem of integrally forming such retainment means to a conventional nail clipper with a minimum of additional material.

It is an object of this invention to provide a retainment device which is easily affixed to an existing nail clipper.

Another object of this invention is to provide a nail clipper which retains the clippings during the clipping process from being scattered to an undesirable location.

Another object of this invention is to provide a retainer which is comfortable to the operator of the nail clipper device.

Another object of this invention is to provide a cutter edge onto the nail clippper mechanism which will be oriented easily to clip a fingernail or toenail.

The foregoing and other objects and advantages will become apparent to those skilled in the art upon reading the description of a preferred embodiment which follows in conjunction with a review of the appended drawings.

DESCRIPTION OF A PREFERRED EMBODIMENT

Figure 1:
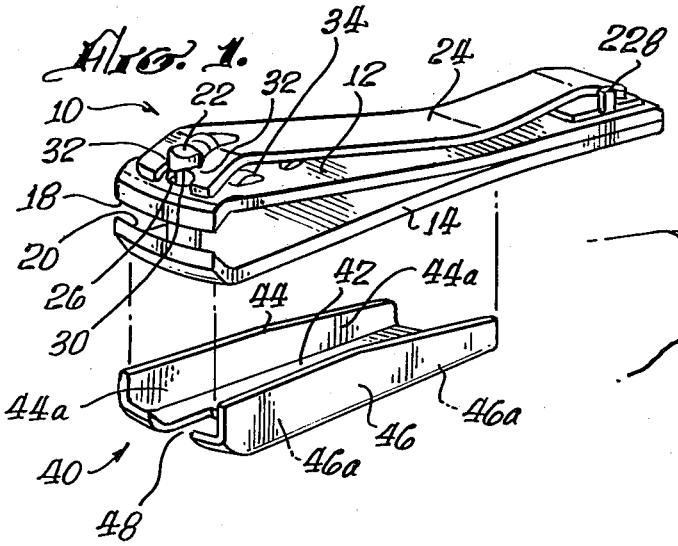
FIG. 1 is an exploded perspective of the nail clipping retainer prior to attachment to a conventional nail clipper.
Figure 2:
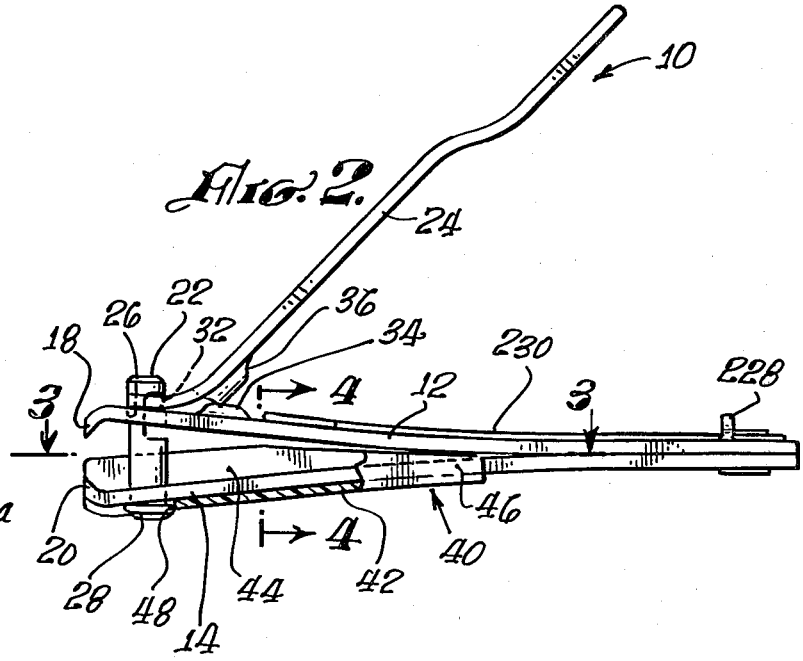
FIG. 2 is an enlarged side elevation of the device of FIG. 1 with certain portions shown in section.

I have illustrated in FIG. 1 a nail clipper assembly 10, having upper and lower arms 12 and 14. To those familiar in the art, it is known that these arms are joined together at 16 by weldment, or the like, allowing the upper and lower arms 12 and 14 to retain a spring-like characteristic. Cutting edges 18 and 20 are formed in a conventional manner on the arms 12 and 14. A pin 22 is pivotally connected to a lever 24. This lever can be placed into a stored condition as shown in FIG. 1 or can be placed into position for actuating the nail clipper as shown in FIG. 2. The pin 22 passes through a hole 26 in the upper arm 12 and is formed with a pin head 28. A notch 30 cut into the pin accommodates projections 32 on the lever 24 in a manner that is well known in the nail clipping art. A boss 34 formed on lever 24 abuts a bifurcated boss 36 on the upper arm 12 in order to place the lever 24 into a proper actuating alignment to clip nails. A hole 28 in lower arm 14 is provided for the pin 22.

Figure 4:
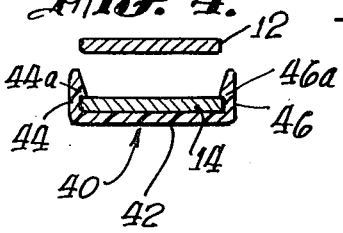
FIG. 4 is a section taken on line 4—4 of FIG. 2.
Figure 3:
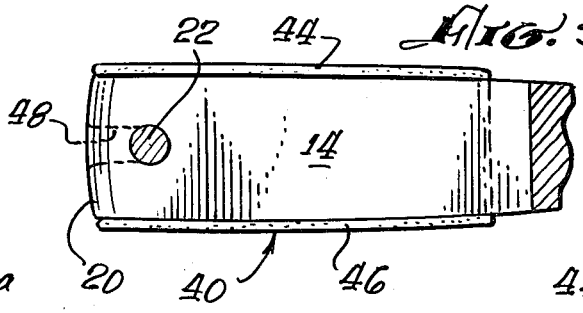
FIG. 3 is a fragmentary section taken on line 3—3 of FIG. 2.

A clipping retainer 40 which is constructed of a material such as plastic is made of a shape to snap onto the lower arm 14 of the clipper assembly 10. This clipping retainer is constructed with a base 42 connecting left and right side walls 44 and 46.A slot 48 is formed into the clipping retainer base wall 42 to circumvent the head 28 of the pin 22. The clipping retainer is held onto the lower arm 14 by means of projections 44*a* and 46*a* as shown in FIG. 4. Thus, it can be seen that the clipping retainer can be easily snapped onto the lower arm of a conventional nail clipper and present a catching mechanism for the clippings after the nails have been clipped. When there has been sufficient accumulation of these clippings then the retainer could be unsnapped and cleared of the clippings or the clippings can be shaken out of the nail clipper and clipper retainer assembly when the cutting edges have been moved apart.

Figure 5:
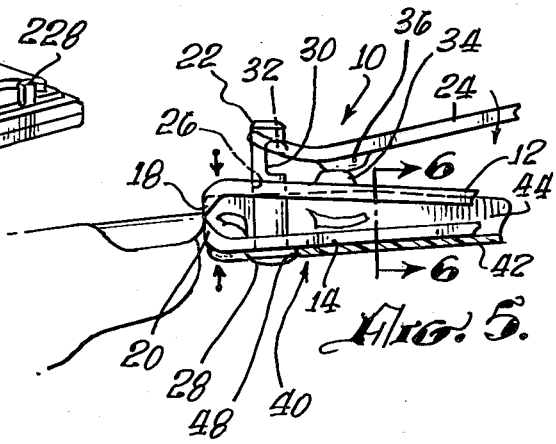
FIG. 5 is a side elevation similar to FIG. 2 but showing the nail clipper and nail clipping retainer in an assembled condition as it is utilized during a nail clipping operation.

FIG. 5 illustrates the manner in which a nail clipping is thrown into the compartment by the upper and lower walls of the nail clipper and the side walls of the clipping retainer.

Figure 6:
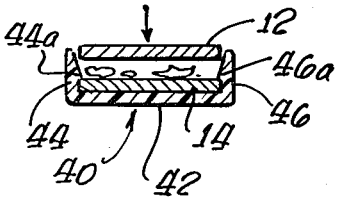
FIG. 6 is a section taken on line 6—6 of FIG. 5.
Figure 7:
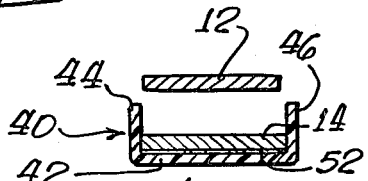
FIG. 7 is a sectional view similar to FIG. 4 of an alternate embodiment.

FIG. 7 illustrates an alternate method of retaining the clipping catcher by applying an adhesive 52 or an adhesive strip to keep the clipping retainer affixed to the lower arm 14 of the nail clipper assembly. The side walls shown in FIGS. 4 and 6 show the upper portion of the side walls as being narrowed in order to accommodate the movement of the upper wall 12 in its downward position. In FIG. 7 the upper arm 12 can move down between the side walls of the clipping retainer which has had the projections 44*a* and 46*a* removed.

Figure 8:
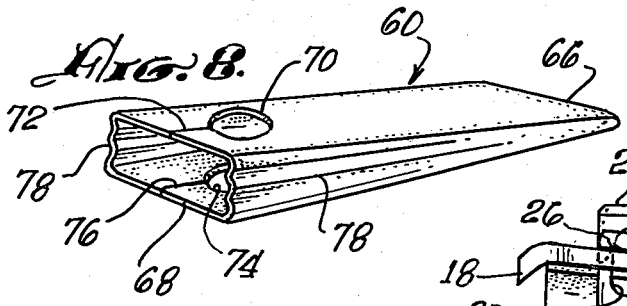
FIG. 8 is a perspective view of an alternate embodiment of a retainer for nail clippings.
Figure 9:
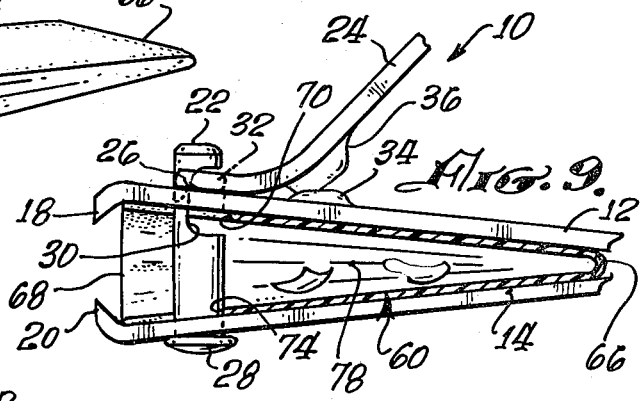
FIG. 9 is a side elevation partly in section of the device of FIG. 8 inserted into a conventional nail clipper.

The nail clipping retainer 60 which is shown in FIG. 8 is placed between the upper and lower arm 12 and 14 of the nail clipper 10 and acts as a clipping catcher during the clipping operation. The upper and lower walls 62 and 64 are closed at one end 66 and open at a forward end 68. Upper and lower openings 70 and 74 are provided with slits 72 and 76 which allow for the retainer 60 to be easily inserted into position surrounding the pin 22. The flexibility of the container 60 is enhanced by providing bellows-like folds 78 in the side walls. This container can be easily removed from the clipper assembly for emptying or other clippings can be shaken out of the front end after the clipper jaws have been pulled apart.

Figure 10:
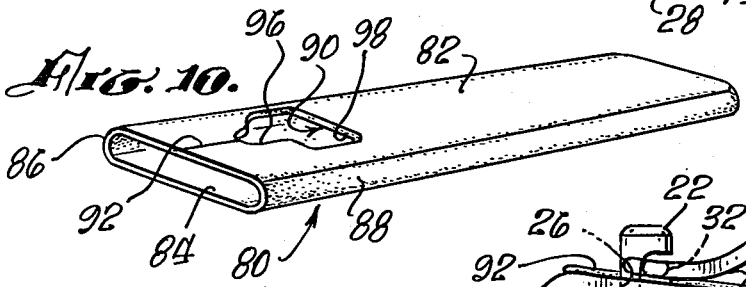
FIG. 10 is a perspective of yet another alternate embodiment of the nail clipping retainer.
Figure 11:
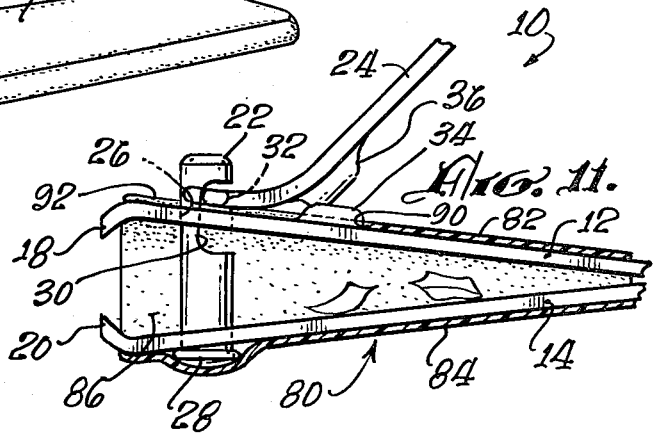
FIG. 11 is a view similar to FIG. 9, but illustrating the latest alternate embodiment of FIG. 10.

The perspective of FIG. 10 and the section of FIG. 11 indicate an alternate embodiment of nail clipping retainer which is formed of a rubber-like material having upper and lower walls 82 and 84 which are interconnected by side walls 86 and 88. An opening 90 of a particular configuration allows the unit 80 to be slipped over the upper and lower jaws of the nail clipper by means of passing a slit 92 past the pin 22 and having the narrow portion 96 of the opening 90 to surround the pin. The wider area 98 of the opening 90 is of such configuration to allow the bosses 34 and 36 to function properly. It is seen from this construction that the assembly 80 can be conveniently placed over all shapes and sizes of nail clipper because of its stretchable nature.

Figure 12:
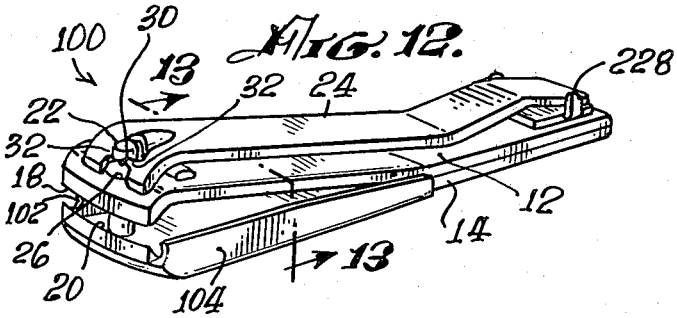
FIG. 12 is a perspective view of an alternate embodiment of nail clipper employing an integrally constructed nail clipping retainment means.
Figure 13:
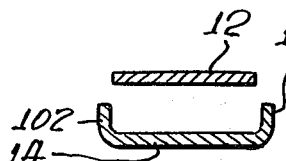
FIG. 13 is a section taken on line 13—13 of FIG. 12.
Figure 14:
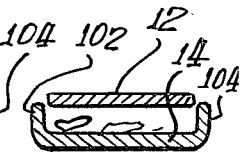
FIG. 14 is a section similar to FIG. 13 but showing a different position of the retainment elements.

The alternate embodiment 100 shown in FIG. 12 comprises a pair of side ribs 102 and 104 which are formed integrally with the upper and lower arms 12 and 14. During the clipping operation the cutting jaws are close together and the side walls retain any clippings from being thrown away from the immediate clipping operation. The sections shown in FIGS. 13 and 14 show how the side walls accommodate the movement of the upper arm 12 during the clipping operation.

Figure 15:
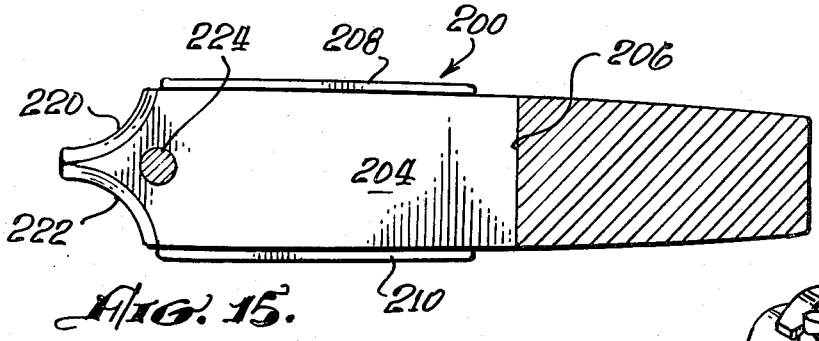
FIG. 15 is a section similar to FIG. 3 of an alternate embodiment of a multiple nail cutting head.
Figure 16:
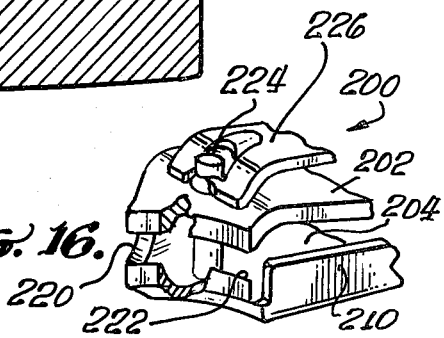
FIG. 16 is a fragmentary perspective of the device of FIG. 15.

FIG. 15 is an alternate embodiment which uniquely provides a pair of cutting edges to perform the clipping operation. The overall unit 200 is shown in FIG. 16 as having an upper and lower arms 202 and 204. As shown in FIG. 15 these arms are joined together at 206 and form a structure similar to the FIG. 1 configuration. Side walls 208 and 210 provide the retainment features of the previously described embodiments. A first arcuate clipper 220 is shown at approximately 45 degrees from the longitudinal axis of the nail clipper assembly. The second arcuate clipper edge 222 is shown at approximately 45 degrees from the longitudinal axis and in the opposite direction of the cutting edges 220. A pin 224 can aid in the actuation of the nail clipper assembly similar to the form described in FIGS. 1 through 5. The lever 226 operates in the same manner and can be placed into a retainer clip 228 during storage. A file 230 can be pivotally attached to any of the various embodiments described.

It is to be understood that the embodiments described herewith can be alternately placed on the various configurations of nail clippers including the ones shown in the application. The materials of constructing the nail clipper assemblies can be of a washable and safe nature to be used close to the human body.

While the embodiments of this invention shown and described are fully capable of achieving the objects and advantages desired, it is to be understood that such embodiments are for the sole purpose of illustration and not for the purpose of limitation.

I claim:

1. A nail clipping retainer means to be removably attached to a nail clipping device of the class which includes a stationary plate means cooperating with a movable plate means which in turn are joined together at one end and have at the opposite ends of said stationary and movable plate means cutting edges of the type that cut toe and finger nails, said movable plate means being moved relative to said stationary plate means by a pivoted lever means, said nail clipping retainer means includes: a "U"-shaped elongated channel means; a central web means of said channel means; parallel side wall means integrally formed with said central web means and said wall means projecting normally from central web means; said side wall means of a height that forms a compartment for retaining clipped toe and finger nails after being clipped by said cutting edges; the terminating upper surface of said side walls being parallel to said stationary plate means of at least one half the length of said elongated "U"-shaped channel means; the said terminating upper surface of said side walls being not parallel to the movable plate means along the one half of the length of said elongated "U"-shaped channel means so that when the movable plate means is in its opened position there will be a tapered opening between said movable plate means and the terminating upper surfaces of said side walls which are parallel to said stationary means for at least half the length of the elongated "U"-shaped channel means in order that clippings may be disposed from the interior of the clipper by use of the opening existing between the parallel side walls and the movable plate means; said second half of said upper surface being parallel to said movable plate means and extending to the end of said "U"-shaped elongated channel means which is at the end of said elongated channel means nearest said point of joining together of said movable and stationary plate means; and retaining means located on said side walls for removably retaining said "U"-shaped elongated channel means to said stationary plate means.

2. The apparatus as set forth in claim 1 wherein central web means is provided with a slot for encompassing a head of a connecting pin means which pin means limits movement of said movable plate means relative to said stationary plate means, and said slot being located at the edge of said central web means closest to said cutting edges of said nail clipper.

* * * * *